United States Patent [19]

Kirilloff et al.

[11] Patent Number: 4,964,346

[45] Date of Patent: Oct. 23, 1990

[54] COMPOSITE PEDESTAL LINER

[75] Inventors: Victor V. Kirilloff, Lincoln, Nebr.; Robert Cummins, Pittsburgh, Pa.; William A. Benson, Pittsburgh, Pa.

[73] Assignee: Mosebach Manufacturing Company, Pittsburgh, Pa.

[21] Appl. No.: 456,537

[22] Filed: Dec. 26, 1989

[51] Int. Cl.[5] ..... B61F 5/00; B61F 5/26

[52] U.S. Cl. ..... 105/225; 105/220; 105/218.1

[58] Field of Search ..... 105/218.1, 220, 222, 105/225

[56] References Cited

U.S. PATENT DOCUMENTS

| | | | |
|---|---|---|---|
| 1,814,099 | 7/1931 | Todd . | |
| 1,903,859 | 4/1933 | Glascodine . | |
| 2,295,520 | 9/1942 | Parke | 105/225 |
| 3,553,638 | 1/1973 | Sublett | 308/3 |
| 4,094,253 | 6/1978 | Gage | 105/225 |
| 4,106,876 | 8/1978 | Tregoning | 403/4 |
| 4,168,666 | 9/1979 | Gage | 105/225 |
| 4,170,180 | 10/1979 | Houston | 105/225 |
| 4,313,384 | 2/1982 | Holden et al. | 105/225 |
| 4,316,417 | 2/1982 | Martin | 105/197 |
| 4,327,474 | 5/1982 | Holden | 29/149.5 |
| 4,330,498 | 5/1982 | Kleykamp | 264/251 |
| 4,333,404 | 6/1982 | Kleykamp | 105/225 |
| 4,380,199 | 4/1983 | Thomson et al. | 105/225 |
| 4,433,629 | 2/1984 | Roush, Jr. | 105/222 |
| 4,444,294 | 4/1984 | Yoshigai | 188/24.11 |
| 4,469,466 | 9/1984 | Hotz | 403/388 |
| 4,478,154 | 10/1984 | Holden et al. | 105/225 |
| 4,657,296 | 4/1987 | Nishii | 296/4 |
| 4,825,777 | 5/1989 | Cummins | 105/225 |

*Primary Examiner*—Robert J. Oberleitner
*Assistant Examiner*—S. Morano
*Attorney, Agent, or Firm*—Buchanan Ingersoll

[57] ABSTRACT

A pedestal liner for a railway truck or the like is generally U-shaped in horizontal section with a central web portion of anti-friction material which fits between the wear face of the pedestal and a side of a journal box positioned therein, and a flange or leg on each side bearing on the inner or outer face respectively of the pedestal leg. The flanges are not integral with the web portion but fit into the web and have holes in their outer ends which correspond with the bolt holes in the pedestal. Separate flanges may be provided for different bolt hole locations.

6 Claims, 3 Drawing Sheets

COMPOSITE PEDESTAL LINER

This invention relates to improvements in trucks for railroad diesel electric locomotives and other railroad vehicles. It is more particularly concerned with pedestal wear liners for the elements of the trucks which are slidably engaged to enable the truck wheels to move relative to each other and to the vehicle in a vertical direction.

RELATED APPLICATION

U.S. Pat No. 4,825,777 by Robert Cummins for Pedestal Liner filed Sept. 2, 1987.

BACKGROUND OF THE INVENTION

Trucks for locomotives or other railroad vehicles comprise a pair of side frames tied together by a bolster. In pedestal trucks, so called, the pedestals are integral with the side frames and are formed in inverted U-shape. Between the legs of the U is fitted a journal box so that it can move vertically with respect to the pedestal and the vehicle being supported on the truck. To minimize the wear of the pedestal in the journal box, antifriction materials are interposed between the sides of the journal box and the adjoining surfaces of the pedestal legs. A considerable number of materials has been proposed for pedestal liners, both metals and plastics, but all such liners must be removed and replaced from time to time. This invention is concerned with a form of pedestal liner which facilitates replacement.

SUMMARY OF THE INVENTION

Pedestal wear liners are generally U-shaped in horizontal section with a central web portion or bight which fits between the wear face of a pedestal and a side of its journal box and a flange or leg on each side, one flange bearing against the inside and the other the outside face of the pedestal leg. Thus each pedestal leg has its own liner. The liners are held in place by bolts which pass through holes in the liner flanges and into holes in the truck pedestals. However, each manufacturer of railroad vehicles locates the bolt holes in its own pattern which necessitates the manufacture of a variety of replacement pedestal liners each significantly differing from the others only in the pattern of its bolt holes. The pedestal liners of my invention to be described hereinafter fit pedestals with different bolt hole patterns by being formed with attaching members which are not integral with the bight, the effective element of which is one or more blocks of antifriction material. The block is formed with one or more transverse apertures extending from side to side and the attaching members are dimensioned each at one end to fit within those apertures. The other or outside end of each member is bent at a right angle to the end within the aperture so that when my apparatus is assembled the outside ends overlie the sidewalls of a truck pedestal in the regions of its mounting holes, and the outside ends of my attaching members have bolt holes which are positioned to match the bolt holes of the pedestal.

The attaching members may be fixed within the antifriction member in which case the bolt holes of the attaching members may be elongated along at least one axis so as to overlie pedestal bolt holes in at least two different patterns. In another embodiment of my invention separate attaching members may be inserted into my antifriction block from each side. Separate attaching members may then be provided with bolt holes positioned to align with each separate pattern of bolt holes in pedestals. The fastening bolts, of course, hold the attaching members against the pedestal on each side.

In another embodiment of my invention separate attaching members may be inserted into the apertures of the antifriction block from each side and joined or connected together at the center of the block. For this embodiment the antifriction block must be formed with one or more central cutout portions, or the unitary block must be replaced by a pair of narrow upright blocks spaced from each other across the pedestal face. In the central cutout embodiment a cutout must interrupt each transverse aperture and in one version it is convenient to offset the apertures on one side of the block from those on the other side by an amount equal to the thickness of the attaching member so that the attaching members inserted from opposite sides of the block overlap within the cutout. Connecting holes in the inside ends of the attaching members are aligned to accept a conventional fastener.

Alternatively as mentioned above, the antifriction blocks may be replaced by two upright narrow blocks spaced from each other to leave an open central space within which the inner ends of aligned attaching members can be connected. They may be joined as above described or the inside end of each attaching member may be formed to terminate in a screw threaded end and those ends of opposite attaching members are joined by a turnbuckle nut.

DESCRIPTION OF THE PREFERRED EMBODIMENTS

Figure 1:
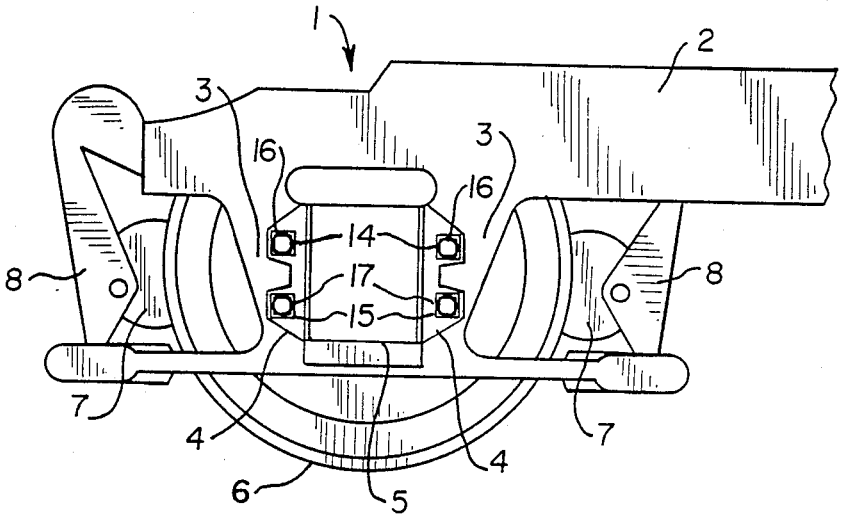
FIG. 1 is an elevation of the side frame of a pedestal truck illustrating the pedestal liners of my invention.

FIG. 1 illustrates a railroad truck of the pedestal type having a side frame 2 and pedestal legs 3—3. Attached to pedestal legs 3—3 are the assembled pedestal liners 4—4 of my invention. The pedestal liners 4 fit against the inside surfaces of the pedestal legs 3 of side frame 2 on each side. A journal box 5 fits between opposite pedestal liners 4—4 so as to slide vertically with respect to pedestal legs 3—3. Wheel 6, brake shoe 7 and brake link 8 are not part of my invention. Pedestal liners 4—4 are attached to legs 3—3 by attaching members 9 which are affixed to the liner element 10 and overlap the pedestal legs 3—3 on their inside and outside faces. Bolts 11 pass through holes in the outer ends of members 9 and mating holes in pedestal legs 3—3 as will be described hereinafter.

Figure 3:
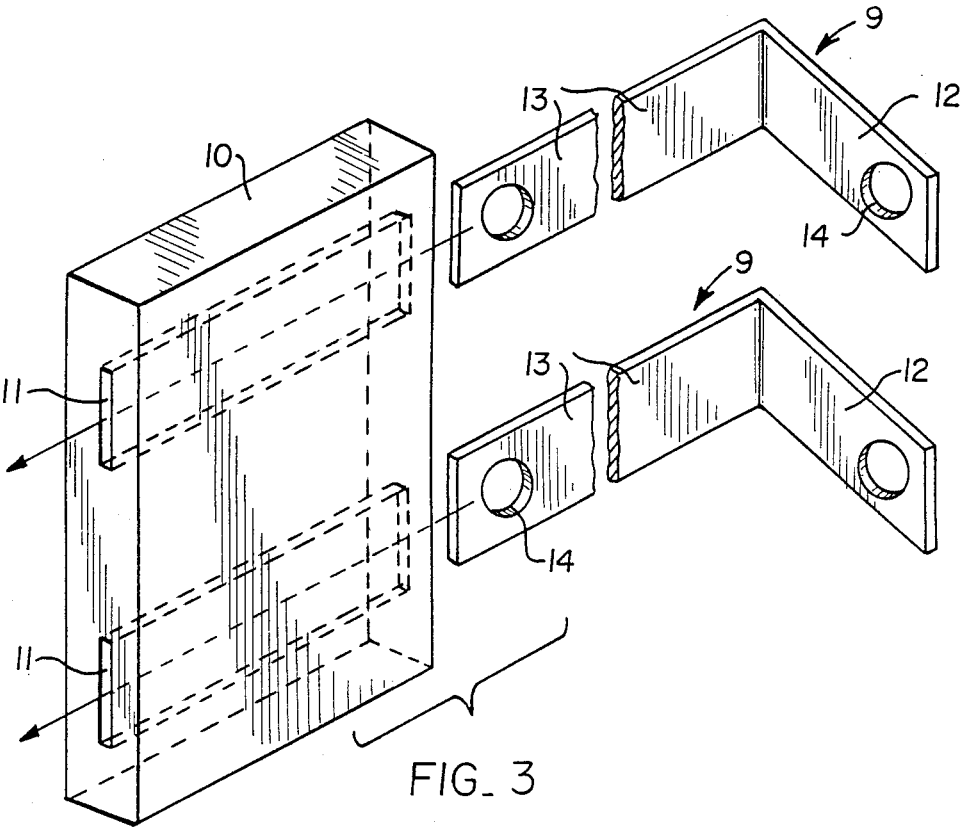
FIG. 3 is an exploded view of a partially assembled second embodiment of my invention.
Figure 2:
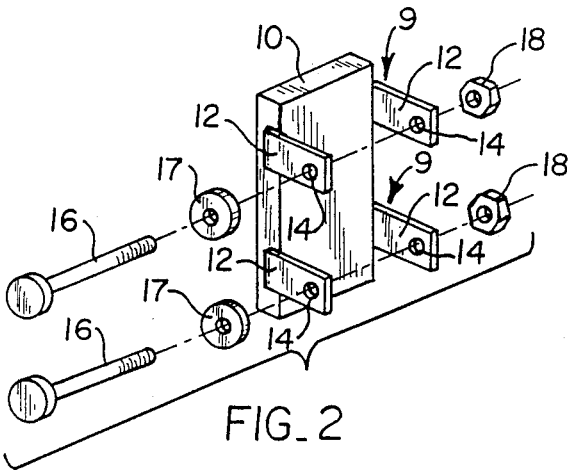
FIG. 2 is a partially exploded assembly of one embodiment of my invention.

FIG. 2 is an exploded view of one embodiment of a pedestal liner of my invention and its fasteners. The antifriction element 10 of my liner is a block of nylon or other antifriction material fitted with attaching members 9—9 made of flat strip metal. The members 9—9 pass through liner block 10 in transverse apertures 11 preferably molded in those blocks as may be seen in FIG. 3. The members 9, preferably metal straps, are bent into right angles with a short leg 12 and a long leg 13 which long leg is passed through aperture 11 until short leg 12 is against the edge of block 10. The length of leg 13 is made equal to the width of block 10 plus the length of a short leg 12 and the projecting end of the strap is bent at right angles to the enclosed portion to make a short leg 12 on the opposite side of block 10 as is shown in FIG. 2. The outer ends of short legs 12 have bolt holes 14 which may be predrilled to match with the mounting bolt holes in the pedestal legs. The assembly so formed is fastened to the pedestal by bolts 16, washers 17 and nuts 18 as are shown in FIG. 2.

A modification of my first embodiment employs attaching members 9 on opposite sides with legs 13 dimensioned to approach each other or meet within aperture 11 but not to connect with each other. When the assembled liner is fastened to the pedestal by bolts 16 and nuts 18 previously mentioned, the attaching members 9 cannot be withdrawn.

Figure 6:
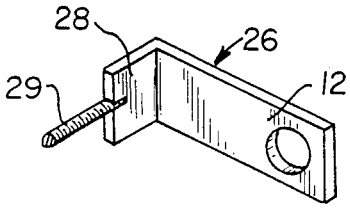
FIG. 6 is an isometric of one form of an attaching member of my invention.
Figure 7:
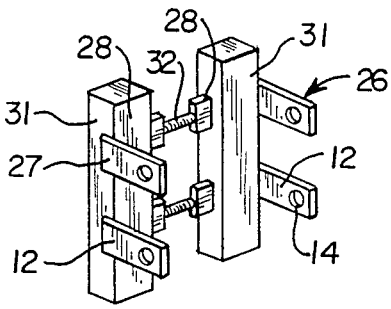
FIG. 7 is an exploded view of a device utilizing the attaching member of FIG. 6.
Figure 5:
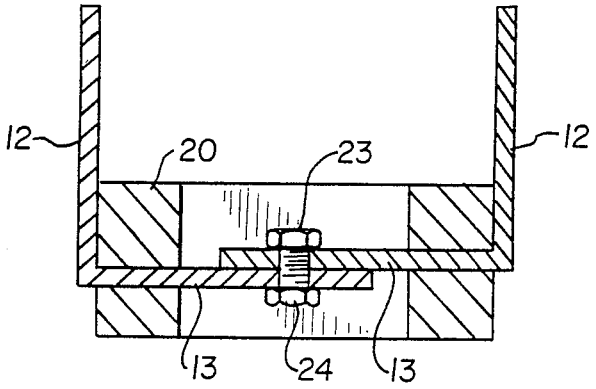
FIG. 5 is a transverse section of the embodiment of FIG. 4 taken on the plane V—V.
Figure 4:
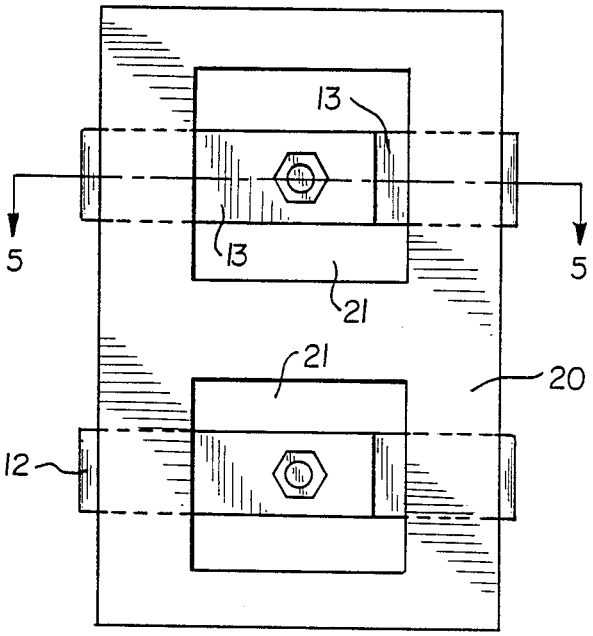
FIG. 4 is an elevation of another embodiment of my invention.

Another embodiment of my invention illustrated in FIGS. 4 and 5 has a liner block 20 with windows 21—21 provided therein positioned so that they interrupt transverse apertures 11—11. Attaching members 9 have short legs 12 as before but legs 13 dimensioned to overlap each other within the area of windows 21—21. The overlapping ends are fastened by any convenient means such as nut and bolt 23 and 24 illustrated. The apertures 11 from opposite sides of block 20 are offset from each other a distance equal to a thickness of a member 9. As before, the outer ends of legs 12 are drilled to match the mounting holes of their pedestal legs. It will be understood that other devices for joining the inner ends of my members 9 may be employed Still another embodiment of my invention utilizes attaching members 26, FIG. 6, having an outside leg 12, previously described herein, and a short inside leg 28 which terminates in a screw threaded end 29 having a diameter equal to or less than the thickness of inside leg 28. Those attaching members are preferably assembled each pair in its own narrow upright antifriction block or strip 31 as shown in FIG. 7 and the threaded ends 29 connected by turnbuckle nuts 32. Attaching members 26 can also be assembled in a block 20 with windows 21. For that arrangement, the opposite apertures 11 should be aligned with no offset.

The outside legs 12 of the attaching members are bored with bolt holes 14 to accept fastening bolts 16. Those bolt holes may be aligned with the bolt holes of the pedestals. Where it is desired to use my pedestal liners with vehicles having different pedestal hole patterns, the bolt holes 14 may be contoured to encompass pedestal bolt holes of more than one pattern if the mismatch between the two patterns is not too great. Alternatively, sets of attaching members can be provided, each set with fastening bolt holes positioned for one pattern of vehicle for the embodiments shown in my FIGS. 3, 4 and 7.

I claim:

1. A pedestal liner for a railway truck having pairs of pedestal legs between each pair of which a journal box is disposed, said liner comprising a bight disposed between a leg and its associated journal box, said legs having pedestal mounting holes therethrough parallel to said bight, and mounting means affixed to said bight and overlying said pedestal mounting hole, said bight being constructed of antifriction material disposed between one of said pairs of pedestal legs and associated journal box, an aperture extending through said bight parallel with one of said pedestal mounting holes and a metal strap in the form of a right angle and having a cross section which fits within said aperture, at least one outer end of said strap having a mounting hole therethrough which is aligned with said pedestal mounting hole when the inner end of said strap is inserted into said aperture.

2. The pedestal liner of claim 1 in which said bight is a block of plastic.

3. The pedestal liner of claim 2 in which said plastic is nylon.

4. The pedestal liner of claim 1 in which said mounting hole through said strap is elongated so as to accept a fastener through a pedestal mounting hole displaced from said one pedestal mounting hole.

5. The pedestal liner of claim 1 in which said bight comprises two upright strips of said antifriction material spaced from each other, said aperture extend through both said strips, the inner end of said metal strap terminating in a screw threaded portion and a turnbuckle nut fitting between said two upstanding strips of antifriction material adapted to draw together the inner ends of two oppositely positioned metal straps.

6. The pedestal liner of claim 1 in which said bight is formed with a centrally located cutout interrupting said aperture, said metal strap has a fastening hole through its inner end and fastening means extending through the overlapping holes in the inner ends of two said oppositely positioned metal straps.

* * * * *